United States Patent [19]

Winnicki

[11] Patent Number: 4,766,637

[45] Date of Patent: Aug. 30, 1988

[54] WET VACUUM APPARATUS

[76] Inventor: James Winnicki, 7500 Whirlaway St., Bakersfield, Calif. 93307

[21] Appl. No.: 145,811

[22] Filed: Jan. 15, 1988

[51] Int. Cl.[4] ..... A47L 5/38

[52] U.S. Cl. ..... 15/314; 4/661; 4/DIG. 7; 15/301; 15/339

[58] Field of Search ..... 15/301, 314, 321, 322, 15/339; 4/252 R, 661, 662

[56] References Cited

U.S. PATENT DOCUMENTS 3,048,875 8/1962 Bottinelli et al. ..... 15/314 X
3,258,809 7/1966 Harvey ..... 15/321
4,641,392 2/1987 Huisma ..... 15/314 X

FOREIGN PATENT DOCUMENTS 807869 3/1969 Canada ..... 15/314

*Primary Examiner*—Chris K. Moore
*Attorney, Agent, or Firm*—Jack C. Munro

[57] ABSTRACT

A wet vacuum apparatus which includes a vacuum head which connects through a flexible hose to a pump. The outlet of the pump connects to a mounting plate with this mounting plate to be installed between a conventional toilet and the floor of a building. The waste material, either dry or wet, is to be discharged directly into the sewage plumbing of the building.

4 Claims, 1 Drawing Sheet

WET VACUUM APPARATUS

BACKGROUND OF THE INVENTION

The field of this invention relates to cleaning apparatuses and more particularly to a wet vacuum apparatus that is to be utilized in conjunction with a building, commercial or residential, which discharges the collected material directly into the sewer plumbing of the building.

The use of vacuum systems, both dry and wet, have long been known. These vacuum systems are commonly used to pick up foreign material within a building such as an office or a house.

Within a wet vacuum, the foreign material is collected within a tank. It is best to empty the contents of this tank after each usage. Within a dry vacuum, the contents are collected within a bag and periodically the vacuum bag is emptied. This emptying of the collecting receptacle and emptying of the bag is not a desirable activity. If this activity could be eliminated and still permit the usage of a vacuum, such a vacuum would be far more desirable to use.

SUMMARY OF THE INVENTION

The primary objective of the present invention is to construct a wet/dry vacuum which eliminates the need of empty any kind of collecting container.

Another objective of the present invention is to construct a vacuum which can be inexpensively purchased by the consumer and can be easily retrofitted into any existing home or business.

The vacuum of the present invention utilizes a conventional vacuum head which is designed to pick up either wet or dry material and conduct such through a flexible hose to a pump. This pump in turn moves the waste material into a passage within a mounting plate. This mounting plate includes a center hole with this center hole being mounted between the conventional toilet and the floor of a building. Connecting with the center hole is a passage which extends from the side wall of the mounting plate. The waste material is conducted into the passage and into the center hole and into the sewer plumbing of the building. The passage is located relative to the center hole to not only direct the discharged waste material in a downward direction toward the floor of the building but also direct the waste material tangentially relative to the hole so as to facilitate the movement of the waste material into the sewer plumbing of the building.

DETAILED DESCRIPTION OF THE SHOWN EMBODIMENT

Figure 1:
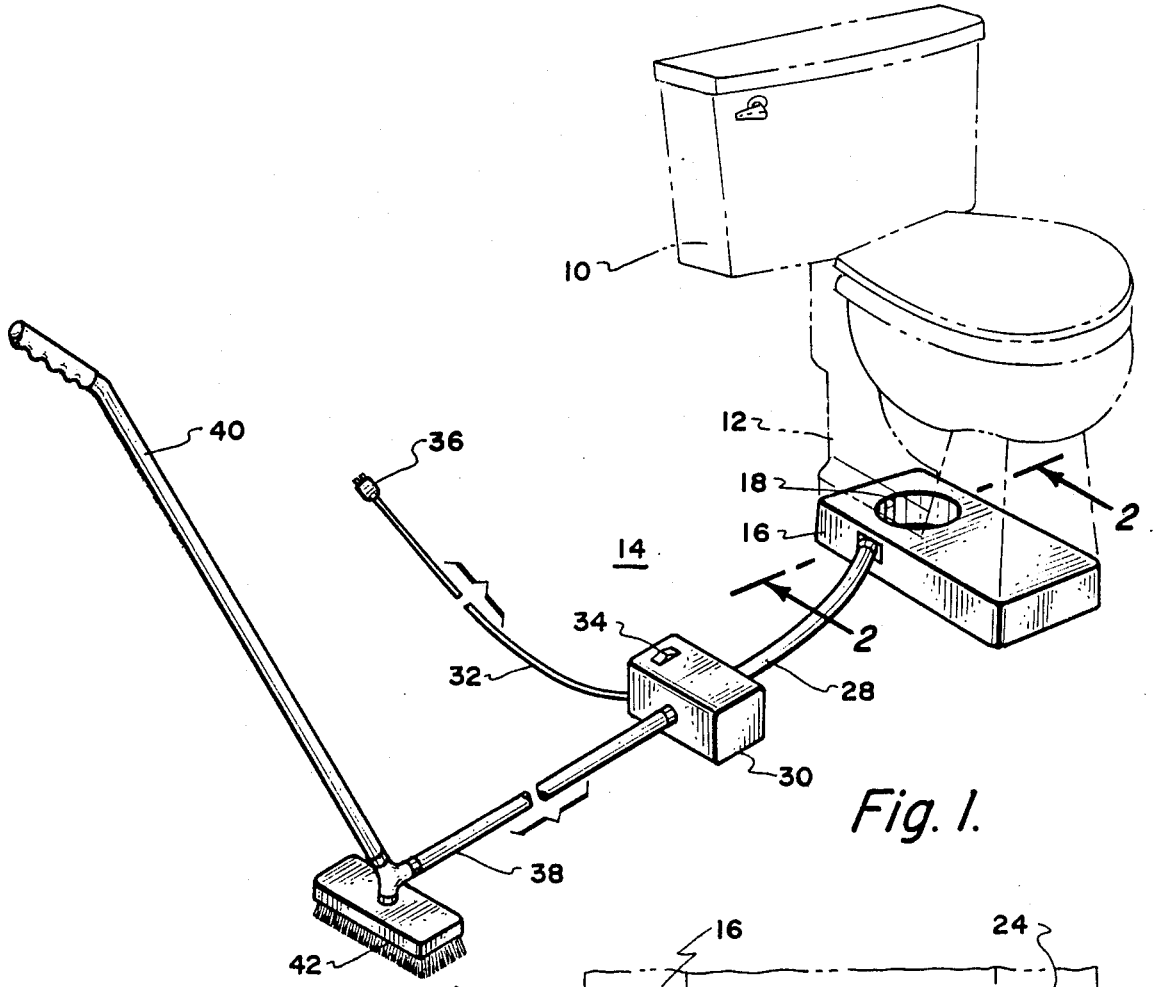
FIG. 1 is a schematic view showing the entire vacuum apparatus of the present invention.
Figure 2:
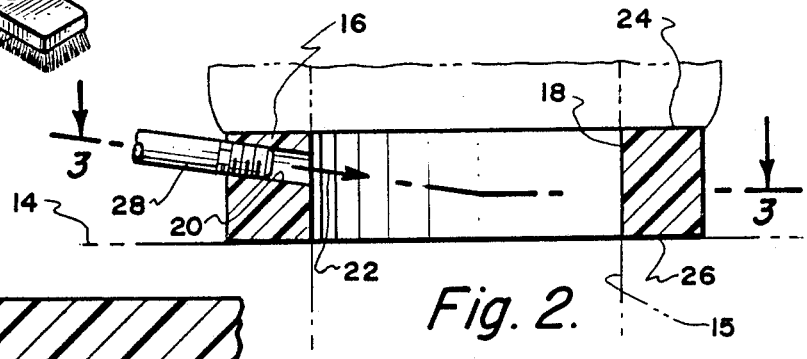
FIG. 2 is a cross-sectional view through the mounting plate utilized in conjunction with the vacuum apparatus of the present invention taken along line 2—2 of FIG. 1.
Figure 3:
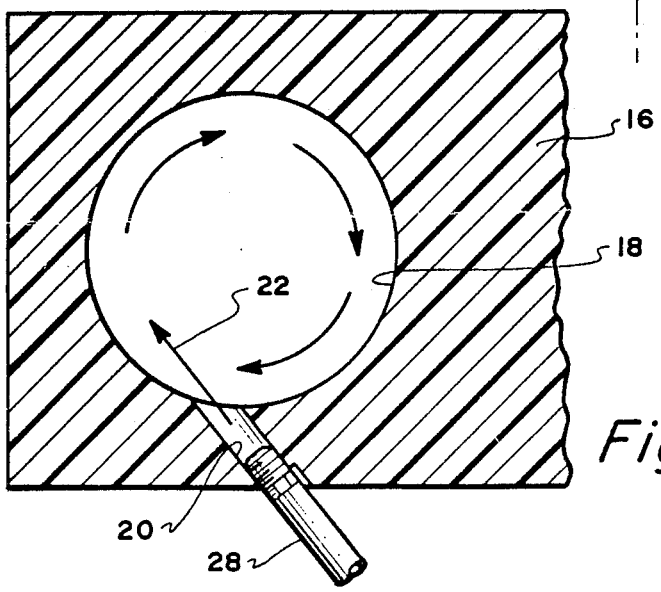
FIG. 3 is a top plan view of the mounting plate taken along line 3—3 of FIG. 2.

Referring particularly to the drawing, there is shown a conventional toilet 10 which is also known as a water closet. The toilet 10 has a base 12. The bowl of this toilet is mounted directly on the floor 14. The opening within the toilet 10 connects in a fluid-tight manner with the opening 15 formed within the floor 14. The opening 15 is part of the sewer plumbing of a building such as a house or a place of business. It is to be understood that this sewer plumbing will connect with either a septic tank or a sewer pipe into which human waste material is to be deposited.

A mounting plate 16 is to be constructed of metal, plastic or other similarly rigid material. This mounting plate 16 will normally have an exterior configuration substantially matching the periphery of the base 12. Within the mounting plate 16 is a center hole 18. Connecting with this center hole 18 is a passage 20 formed through the side wall of the plate 16. This passage 20 connects with the center hole 18. The passage 20 is shown consuming a curved configuration so that the longitudinal center axis of the passage 20 at the point of connection with the center hole 18, are represented by arrow 22, is directed in a downwardly extending direction, that is toward the floor 14. Also, the passage 20 is tangentially disposed relative to the center hole 18. The reason for this is that any material that is forcibly discharged from the passage 20 into the center hole 18 will be given an initial force in a direction down into opening 15. Also, because the passage 20 is disposed tangentially relative to the center hole 18, there is a turbulent swirling action which in essence creates a vortex tending to again direct the discharge waste material down into the opening 15.

The mounting plate 16 has an upper surface 24 and a lower surface 26. The upper surface 24 is to abut against the bottom of the base 12. The lower surface 26 is to be mounted against the floor 14. The center hole 18 is to be in alignment with opening 15. It is to be understood that the mounting plate 16 will be fixedly secured onto the floor 14 and also onto base 12.

Connecting with the passage 20 is a conduit 28. This conduit 28 connects with the outlet of pump 30. The pump 30 includes an on/off switch 34 and is to be operated electrically by an electrical conduit 32 which connects to a plug 36 which is to be plugged into a conventional electrical outlet mounted within the building. The construction of the pump 30 is deemed to be conventional and is designed to move liquid and/or dry waste material.

The inlet side of the pump 30 is connected to a hose 38. This hose 38 is of a given length, such as ten feet, and is constructed to be flexible resembling conventional vacuum cleaner type of hose. This hose 38 terminates in a vacuum head 42. Again, the vacuum head is deemed to be conventional and will normally include some type of a brush which is to facilitate collecting and directing of waste material into the hose 38. The collected waste material from the hose 38 is conducted through the pump 30, into the conduit 28, into passage 20 to be discharged into center hole 18 and hence then into opening 15. In order to facilitate manual movement of the head 42 there is connected to the head 42 a handle 40. This handle 40 is adapted to be grasped and moved by a human being (not shown).

The structure of this invention is designed to be utilized on a retrofit basis in conjunction with a house or building. However, it is to be considered that during the construction of a building, the conduit 28 can be permanently installed in the building to directly discharge the waste material into the sewer plumbing of the building thereby eliminating the need for the plate 16.

What is claimed is:

1. In combination of the floor of a building, said floor having an opening through which waste material is to be conducted, a toilet having a bowl, said bowl to be located about said opening, a wet vacuum apparatus comprising:

a mounting plate fixedly located between said toilet and said floor, said mounting plate having a center hole connecting with said opening, said center hole being adapted to conduct waste from said bowl into said opening;

a passage located within said mounting plate, said passage connecting with said center hole;

a pump connected to said passage; and a hose connected to said pump, said hose terminating in a vacuum head, whereby said pump causes material to be sucked into said vacuum head and through said hose and said pump into said passage and then discharged through said center hole into said opening.

2. The combination as defined in claim 1 wherein:

said passage having a longitudinal center axis, the portio of said longitudinal center axis located directly adjacent said center hole being directed towards the floor, whereby the waste material exiting said passage and into said center hole is discharged in a downward direction toward said floor.

3. The combination as defined in claim 2 wherein:

said longitudinal center axis of said passage at the connection with said center hole being located somewhat tangential relative to said center hole.

4. The combination as defined in claim 3 wherein:

said hose being flexible permitting movement of said vacuum head relative to said mounting plate.

* * * * *